US006106023A

United States Patent [19]

Sud et al.

[11] Patent Number: 6,106,023

[45] Date of Patent: Aug. 22, 2000

[54] GREETING CARD WITH FORMED IMAGE

[76] Inventors: Alexander M. Sud, 3704 Sudbury La.; Jim Berry, 2801 Jomarie Ct., both of Louisville, Ky. 40220

[21] Appl. No.: 09/130,831

[22] Filed: Aug. 7, 1998

Related U.S. Application Data

[60] Provisional application No. 60/086,736, May 26, 1998.

[51] Int. Cl.[7] ..... B42D 15/00; A47G 1/06; G09F 1/00; B65D 73/00

[52] U.S. Cl. ..... 283/117; 206/475; 283/56; 40/124.1

[58] Field of Search ..... 283/107, 117, 283/56; 206/475, 461; 40/124.1; 428/40.1

[56] References Cited

U.S. PATENT DOCUMENTS

| | | | |
|---|---|---|---|
| 2,183,426 | 12/1939 | Hart . | |
| 2,631,046 | 3/1953 | Stephens . | |
| 2,889,651 | 6/1959 | Baldanza . | |
| 2,946,137 | 7/1960 | Worth et al. | 35/35 |
| 3,310,321 | 3/1967 | Freund | 281/31 |
| 3,321,860 | 5/1967 | Dichtl | 40/160 |
| 3,798,806 | 3/1974 | Sanford | 40/28.1 |
| 3,972,417 | 8/1976 | Iten et al. | 206/354 |
| 4,215,499 | 8/1980 | Wilson | 40/158 R |
| 4,380,128 | 4/1983 | Ichikawa . | |
| 4,477,243 | 10/1984 | Wallstén . | |
| 4,579,708 | 4/1986 | Rosart . | |
| 4,737,329 | 4/1988 | Rakoczy . | |
| 4,779,734 | 10/1988 | Kydonieus | 206/470 |
| 4,840,275 | 6/1989 | Faiola . | |
| 4,841,651 | 6/1989 | Conner . | |
| 4,951,404 | 8/1990 | Lithwick | 40/124.1 |
| 4,979,619 | 12/1990 | Hager | 206/509 |
| 5,001,853 | 3/1991 | Odien . | |
| 5,119,574 | 6/1992 | King | 40/537 |
| 5,181,745 | 1/1993 | Jacobsen et al. | 283/94 |
| 5,199,745 | 4/1993 | Balsamo | 283/117 |
| 5,201,548 | 4/1993 | Lang et al. . | |
| 5,217,162 | 6/1993 | Shibahara | 229/92.8 |
| 5,377,836 | 1/1995 | Eisenbraun | 206/461 |
| 5,379,886 | 1/1995 | Brauner et al. | 206/216 |
| 5,600,939 | 2/1997 | Giovannone | 206/462 |
| 5,879,028 | 3/1999 | Benoit | 283/72 |

*Primary Examiner*—Willmon Fridie, Jr.
*Assistant Examiner*—Alisa L Thurston
*Attorney, Agent, or Firm*—Theresa F. Camoriano; Camoriano & Associates

[57] ABSTRACT

A greeting card or keepsake card includes a formed, raised image, and it includes panels which protect the front and rear of the formed, raised image. In a preferred embodiment, the front panel of the card also includes an opening through which one can see the raised image when the card is closed, and the front panel includes a pocket on its inside surface for receiving a compact disk or other flat member. Also in a preferred embodiment, the formed, raised image is surrounded by a raised frame, and the raised image panel defines a flat rear perimeter.

13 Claims, 7 Drawing Sheets

GREETING CARD WITH FORMED IMAGE

BACKGROUND OF THE INVENTION

This application claims priority from U.S. Provisional patent application Ser. No. 60/086,736, filed May 26, 1998. The present invention involves greeting cards, and, in particular, a greeting card having a raised, formed, printed panel.

A wide variety of types of greeting cards is well-known in the art. Cards are known to fold in various ways and to be decorated in a wide variety of ways.

U.S. Pat. No. 3,321,860 "Dichtl" shows a postcard in which a formed image is glued onto a backing card. The concern in that patent is in how to support the raised image so that it can be flattened and then restored to its original shape, and the patent discloses that air may enter and leave the space between the formed image and the backing card, and that there may be projections from the formed image that serve as springs to support the formed image. This type of postcard does not appear to be on the market, which is not surprising, because it would be impossible to manufacture the projections by vacuum forming, and, even if a card were made as taught by Dichtl, it would be damaged when it is mailed or used. It simply is not practical.

SUMMARY OF THE INVENTION

The present invention solves the problem of the raised image card of Dichtl by providing a panel including a formed image in which there is a back panel that is connected to the raised image panel around its rear perimeter and a hinged front panel that protects the front of the raised image. In a preferred embodiment, there is a raised frame around the formed image, which also protects the raised image. With the present invention, the raised image does not deform and become damaged, because it is protected by both the front and rear panels.

In a preferred embodiment, the present invention further provides an opening through the front of the card through which a key element of the raised image is shown when the card is closed, which provides an enhanced effect.

Also, in a preferred embodiment, the inside front of the card has a pocket, which permits the card to carry a compact disk or other flat object. Thus, for example, the card may carry the raised image of a singer and, in the pocket, carry a compact disk on which the singer's work is recorded. Or, as another example, the card may carry the raised image of a landmark and a compact disk describing the landmark or having music relating to the landmark, and so forth.

DESCRIPTION OF THE PREFERRED EMBODIMENTS

Figure 1:
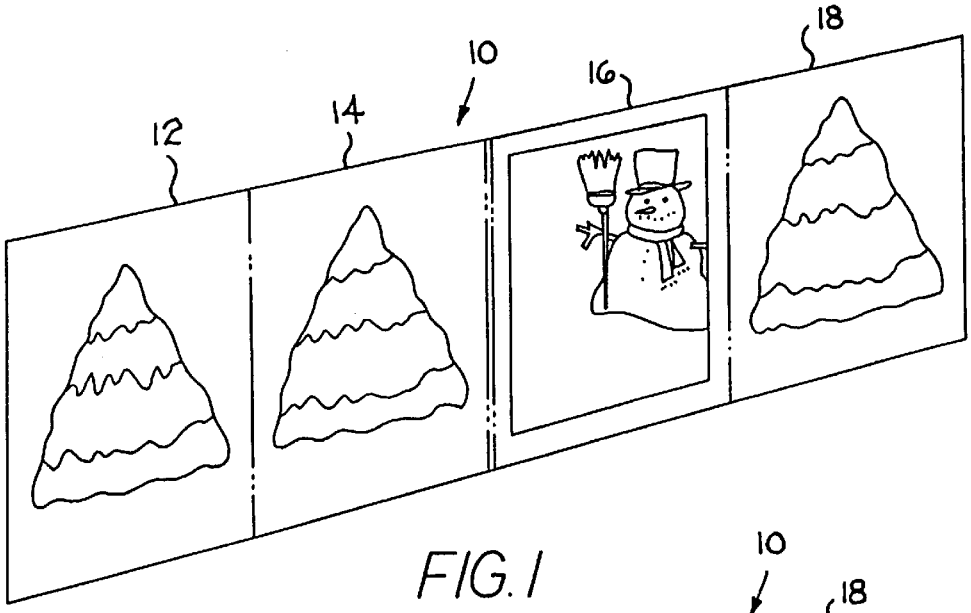
FIG. 1 is a front view of the first stage of a card being made in accordance with the present invention.

FIGS. 1–8 show a first embodiment of a greeting card 10 being made in accordance with the present invention. Referring first to FIG. 1, there is shown a sheet of styrene, polyvinyl, or other formable plastic material. Four panels 12, 14, 16, 18 are defined on this sheet, and the panels are printed with graphics, text, and so forth.

Figure 2:
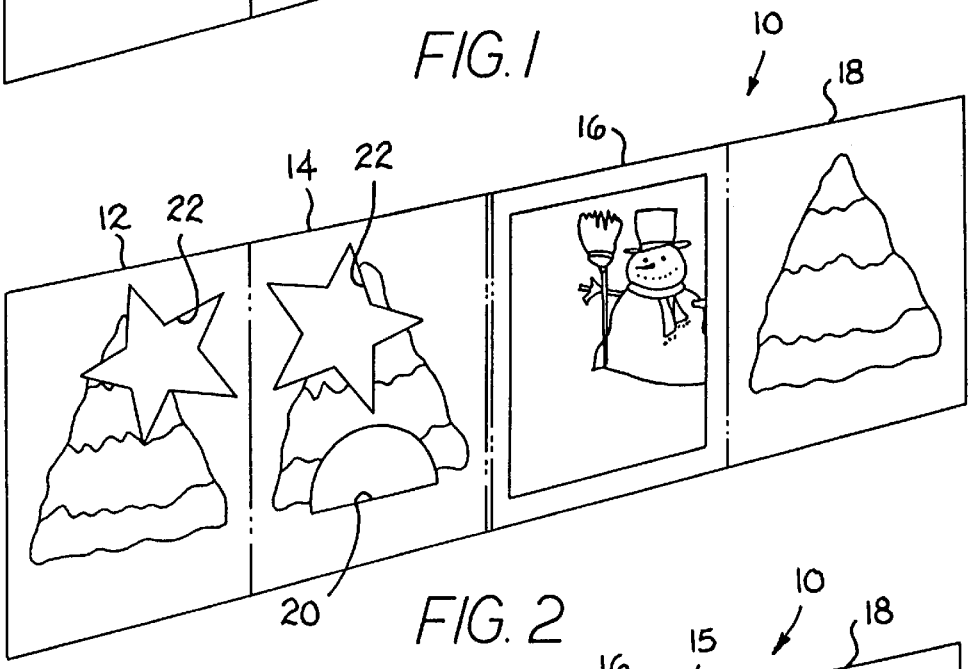
FIG. 2 is a front view of the card of FIG. 1, in the next stage of manufacture.

Once the panels have been printed, the sheet is die cut to form holes 20, 22, as shown in FIG. 2. The holes 22 on panels 12 and 14 will be aligned with each other when the panels are folded to form a hole through the front of the card, as will be shown later.

Figure 3:
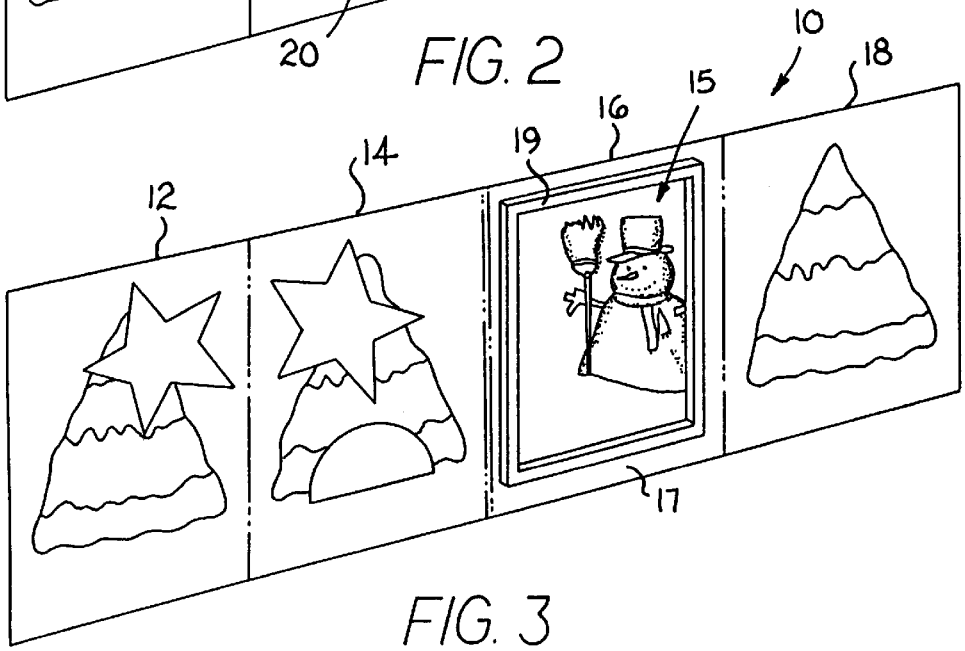
FIG. 3 is the same view as FIG. 2 but showing the next stage of manufacture.

Next, as shown in FIG. 3, the panel 16 is formed, preferably by vacuum forming, into a three-dimensional shape of varying depths, creating a dimensional raised image 15 surrounded by a raised frame 19, which preferably projects forward at least as far as the farthest-projecting portion of the raised image 15. The raised frame 19 is surrounded by a substantially flat border 17, which forms a flat perimeter on the rear of the panel 16. In this preferred embodiment, the front of the raised image 15 is substantially convex, while the rear of the image 15 is substantially concave. The raised image 15 is on the order of 3/16-inch deep or more, which is substantially greater than the typical 1/16-inch depth achieved with paper embossing presently used in mass manufactured greeting cards. Thus, the panel 16 achieves a dramatic three-dimensional effect.

Figure 4:
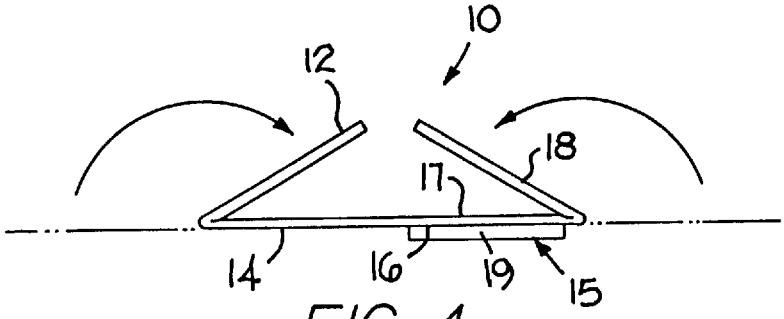
FIG. 4 is a top view of the card of FIG. 3, as it is being folded and glued.
Figure 5:
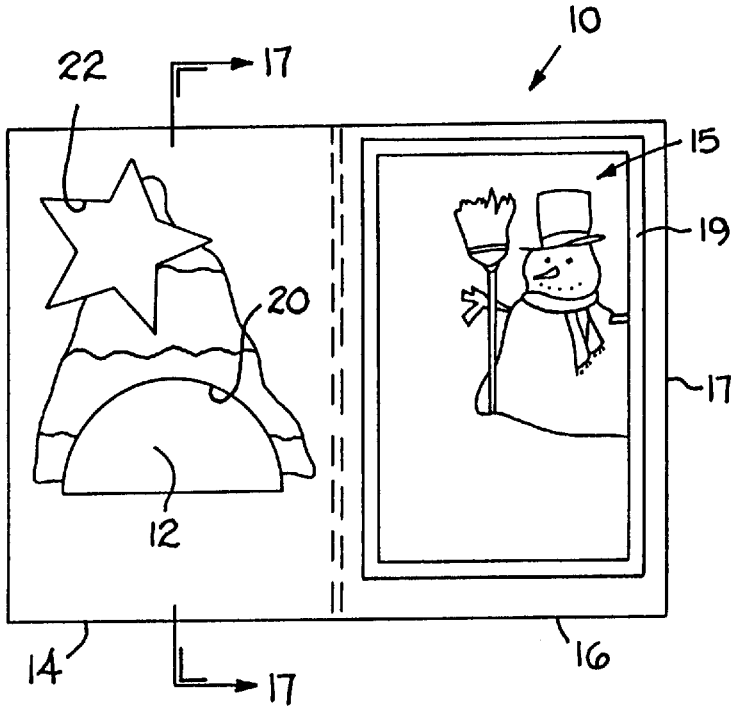
FIG. 5 is a front view of the card of FIG. 4 after it has been folded and glued.
Figure 6:
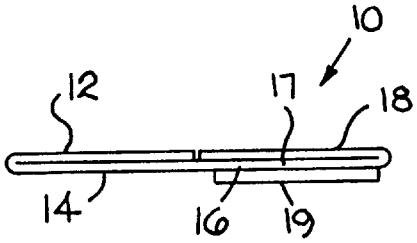
FIG. 6 is a top view of the card of FIG. 5.
Figure 7:
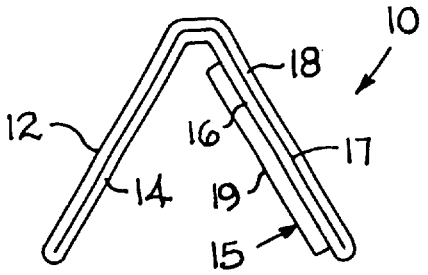
FIG. 7 is the same view as FIG. 6 but with the card being folded.
Figure 8:
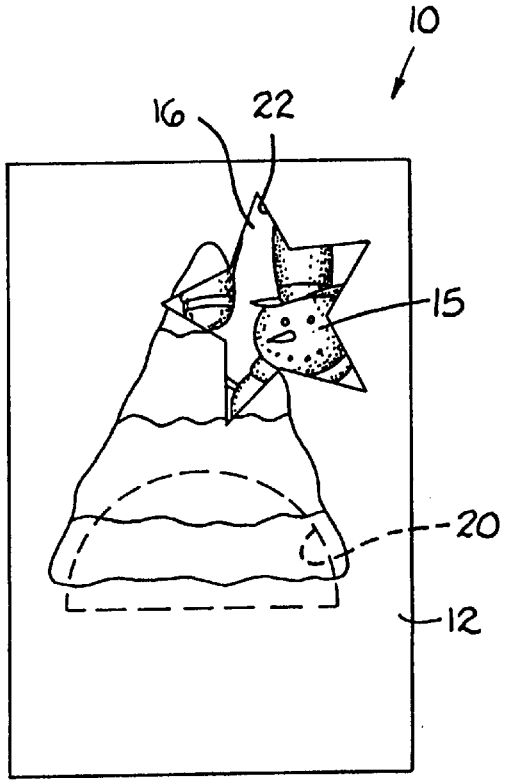
FIG. 8 is a front view of the finished card of FIG. 7.
Figure 9:
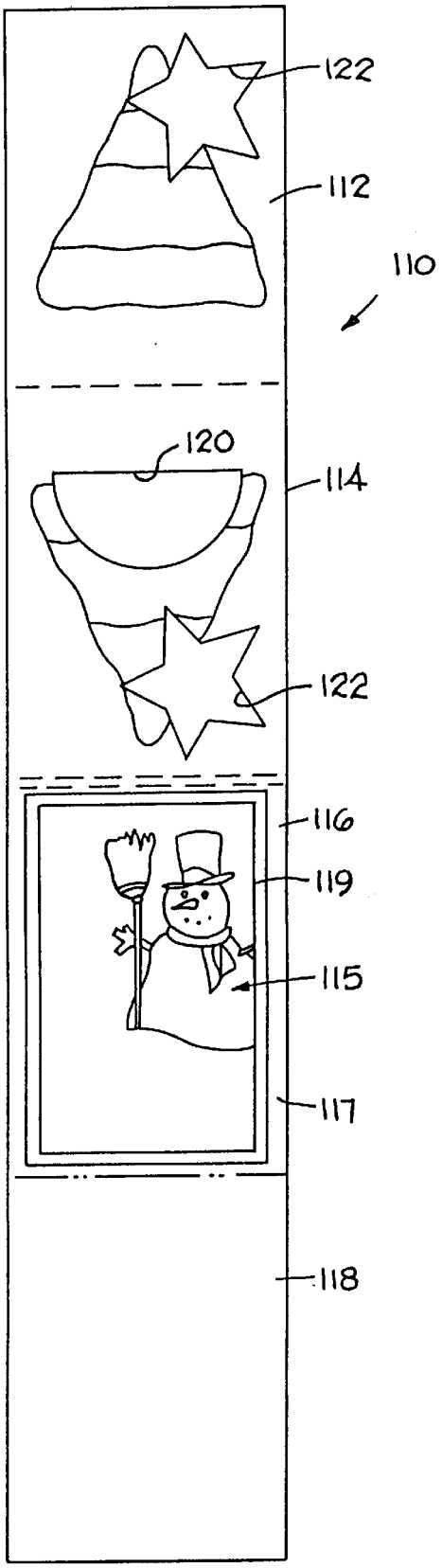
FIG. 9 is a front view of a second embodiment of a card made in accordance with the present invention.
Figure 10:
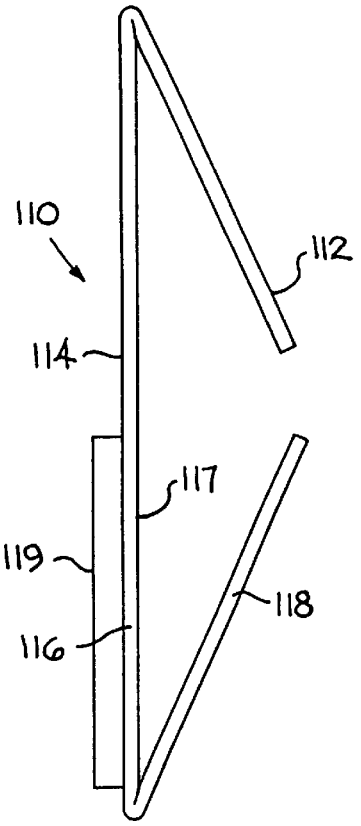
FIG. 10 is a right side view of the card of FIG. 9 as it is being folded and glued.
Figure 11:
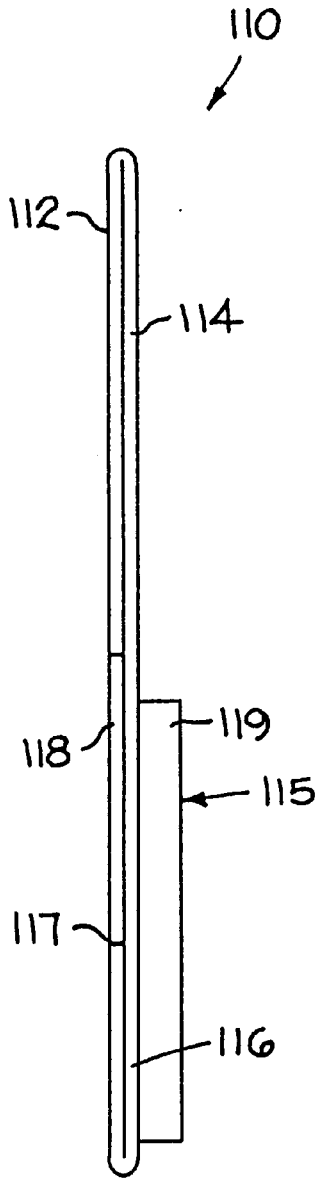
FIG. 11 is a left side view of the card of FIG. 9 after the card has been folded and glued.
Figure 12:
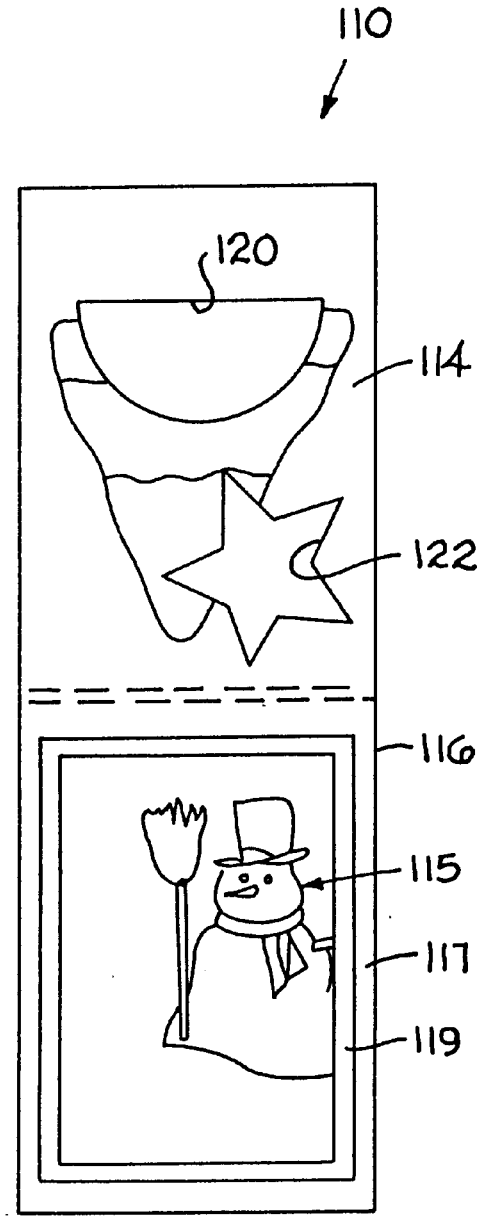
FIG. 12 is a front view of the card of FIG. 11.
Figure 13:
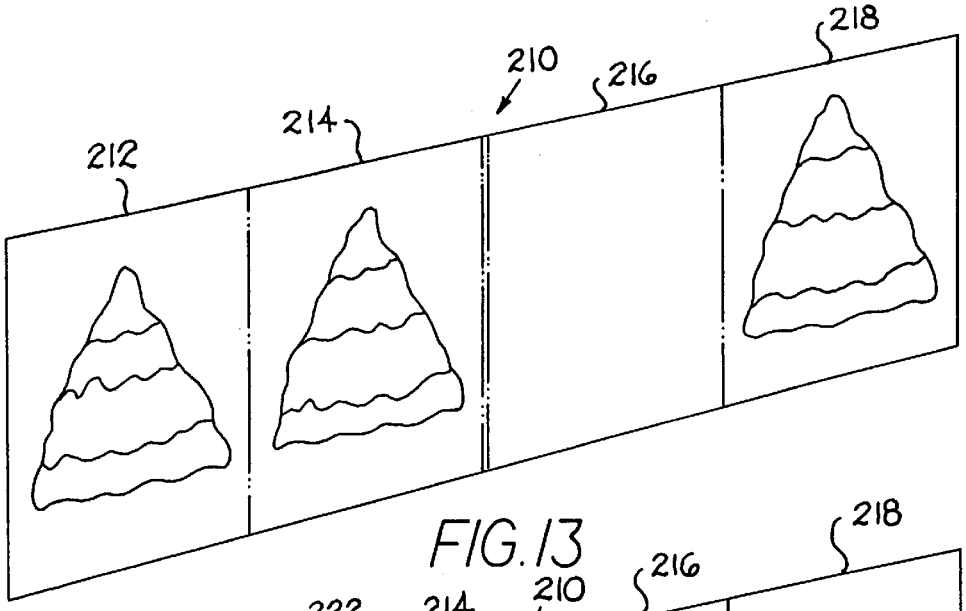
FIG. 13 is a front view of a third embodiment of a card made in accordance with the present invention.
Figure 14:
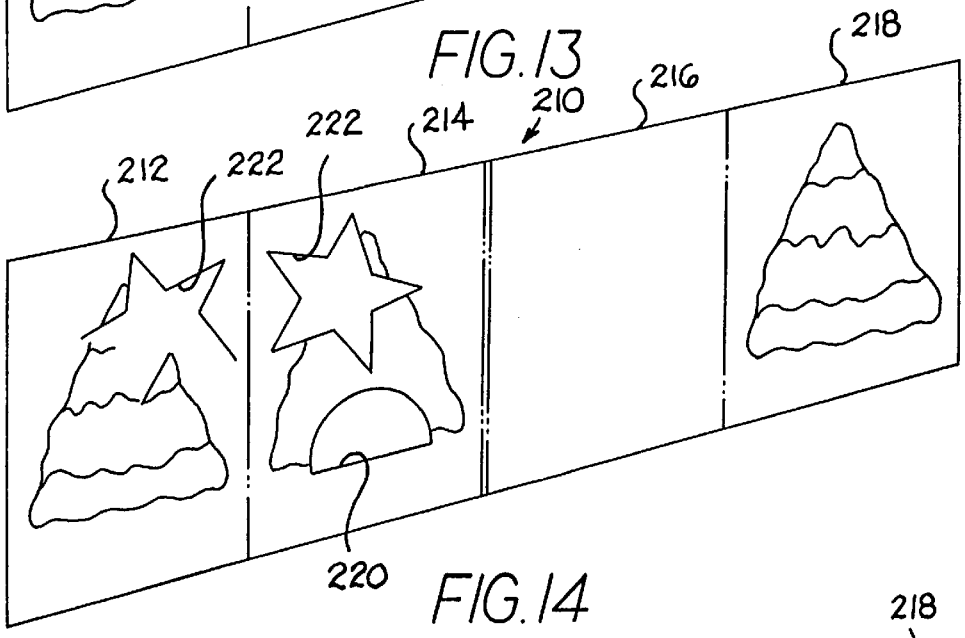
FIG. 14 is a front view of the card of FIG. 13 in the next stage of manufacture.
Figure 15:
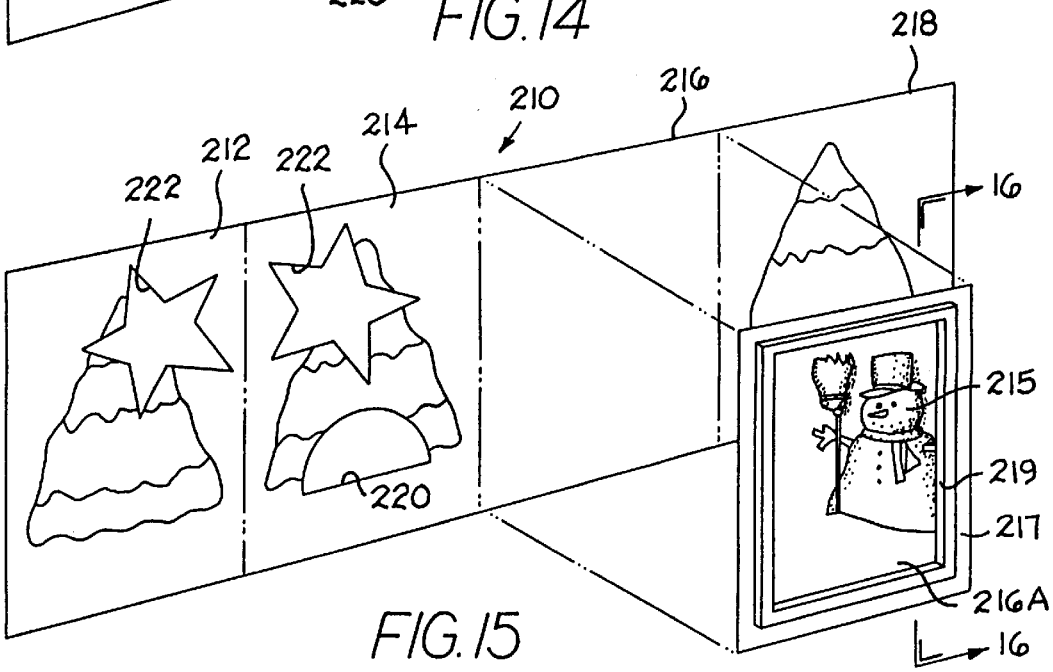
FIG. 15 is a front view of the card of FIG. 14 in the next stage of manufacture.
Figure 17:
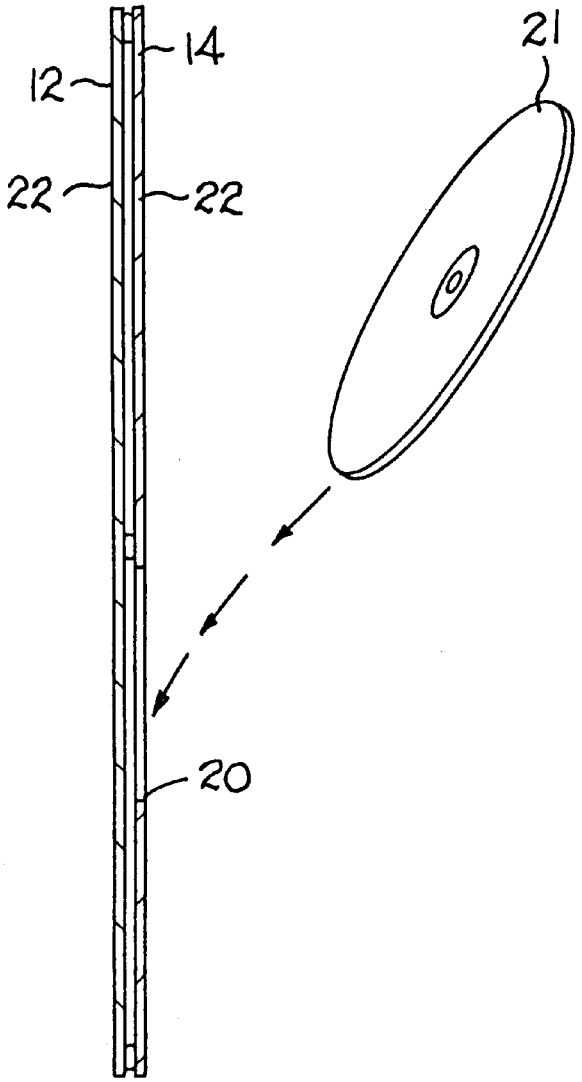
FIG. 17 is a view taken along the section 17—17 of FIG. 5.

Next, the panels are folded as shown in FIG. 4, with the panels 12 and 18 being folded backward. The panel 12 is adhered to the panel 14, and the panel 18 is adhered to the rear of the flat perimeter 17, covering and enclosing the concave back of the panel 16, and giving the back of the card 10 a flat face. FIG. 5 shows the inside of the card 10 after the panels 12 and 18 have been folded and adhered. The panels 12, 14, forming the front of the card, preferably are adhered to each other around their edges, so that the hole 20 provides access into the space between the panels 12, 14, forming a pocket accessible from the inside front of the card. The pocket may be used to hold a compact disc 21 or other desired materials, as shown in FIG. 17. The hole 22 now goes entirely through both panels 12 and 14. Referring now to FIG. 6, one can see that the panels 12, 14 form the front of the card 10, and are hingedly connected to the rear of the card, which is made up of the panels 16, 18. When the card 10 is closed, as shown in FIGS. 7 and 8, the front panels 12, 14 cover the front of the raised image 15. The front panel 14 rests against the raised frame 19, protecting the raised image 15 when the card is mailed or in other normal use.

FIG. 7 shows the front and back of the card 10 being folded together to form the final card 10 shown in FIG. 8. As shown in FIG. 8, from the front of the card, a person can look through the hole 22 and see a key portion of the printed, raised image 15 on the panel 16.

FIGS. 9–12 show a second embodiment of the invention. In this case, the card 110 is made the same way as the first embodiment, with a plastic sheet defining four panels 112, 114, 116, and 118, a raised image 115, raised frame 119 and flat perimeter 117 and die cut holes 120, 122, except that the card 110 ends up folding on the top edge, creating a vertical card, instead of on the side as in the first embodiment. It is understood that the card made in accordance with the present invention may be folded at any other edge and the printing and die-cuts and pockets may be oriented in any desired direction.

Figure 16:
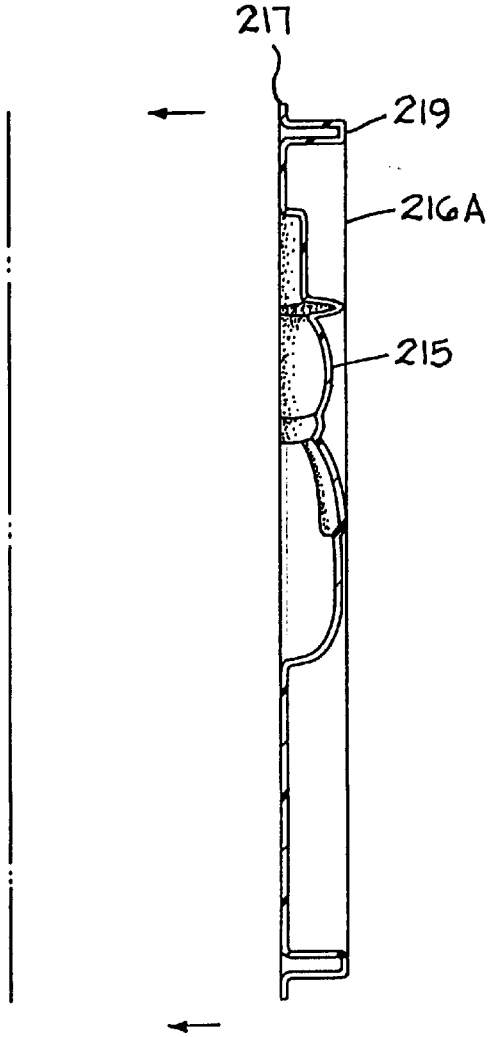
FIG. 16 is a view taken along the section 16—16 of FIG. 15.

FIGS. 13–16 show a third embodiment of a card 210 made in accordance with the present invention. In this embodiment, the panels 212, 214, 216, 218 may be made of paper or other suitable material which is printed and die cut to form holes 220, 222 as in the two previous embodiments. Then, a printed, formed plastic panel 216A (preferably vacuum formed), including a flat perimeter 217 and a raised frame 219, is adhered onto the panel 216 to provide the printed, formed image 215 for the card. FIG. 16 shows that the formed image 215 has a substantially convex front surface and a substantially concave back surface. (The formed images in the previous two embodiments are substantially identical to this formed image, so a section through them would give the identical view.) This view also shows the raised frame 219 and the flat rear perimeter 217. Thereafter, the card is folded and glued just as in the first embodiment. Since this third embodiment makes the raised image from a separate piece of material, it permits different materials to be used for the panels of the card and for the printed, raised image 215 if desired. When this embodiment is used, it would be possible to eliminate the panel 218, since the panel 216 provides protection to the back of the image 215. Similarly, if no pocket is required, it would be possible to eliminate the panel 212 and just provide the panel 214 to serve as the hinged front member.

Figure 18:
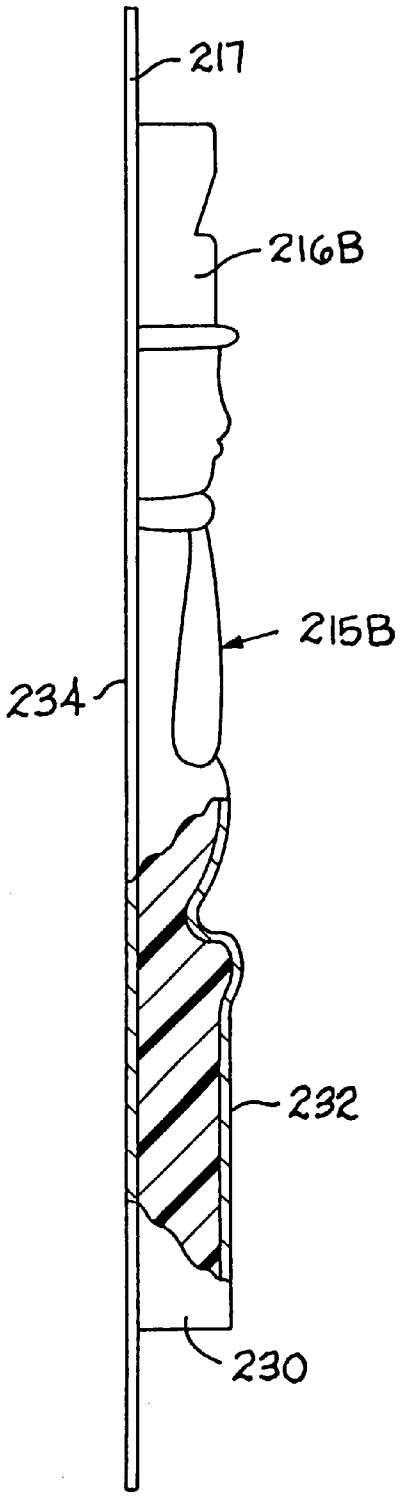
FIG. 18 is the same view as FIG. 16 but showing an alternative embodiment.

While it is now preferred to vacuum form the add-on raised panel 216A, the add-on panel could be formed by other means. For example, FIG. 18 shows an add-on raised panel 216B, which is made from a sheet of plastic foam 230, made of expanded polystyrene or other suitable polymeric material, and having front and rear sheets of paper 232, 234 laminated onto the foam 230. The front sheet 232 has been preprinted with an image. The laminated plastic foam sheet 230 is then deembossed by pressing from the front, using a die to cause portions of the foam to become recessed to various depths. This again results in a contoured, raised image 215B. In this case, it may not be necessary to provide the raised frame, since this raised image 215B is sturdier than the hollow, vacuum-formed raised image. This raised image 215B is solid—not concave—and carries its own flat back panel 234. Other processes could also be used to form the raised image.

It will be obvious to those skilled in the art that modifications may be made to the cards described above without departing from the scope of the present invention.

What is claimed is:

1. A card, comprising:

a plurality of connected panels, including at least one raised plastic panel defining a raised image printed on said plastic panel and having varying depths, said raised plastic panel having a front surface and a back surface;

at least one front panel covering said front surface; and at least one rear panel covering said back surface, such that said front and rear panels protect said raised panel from damage when said card is mailed and in other normal use of the card.

2. A card as recited in claim 1, wherein said rear panel is adhered to the back of said raised panel and said front panel is hingedly connected to one of said rear panel and said raised panel.

3. A card as recited in claim 1, wherein said raised panel defines a raised frame surrounding said raised image and a flat rear perimeter.

4. A card as recited in claim 2, wherein said raised panel defines a substantially flat rear perimeter, and wherein said rear panel is glued to the back of said raised panel at said flat rear perimeter.

5. A card as recited in claim 1, wherein said front panel defines an opening through which a portion of the raised image can be seen from the front of the card when the card is closed.

6. A card as recited in claim 5, and further comprising a pocket defined on said front panel for receiving a compact disk or other flat object.

7. A card as recited in claim 1, wherein said raised, printed image is vacuum formed and defines a convex front surface and a concave rear surface.

8. A card as recited in claim 1, wherein said raised, printed image is deembossed on a foam sheet, and said rear panel is laminated onto the rear of said foam sheet.

9. A card, comprising:

a formed, raised plastic panel defining a raised image and front and rear surfaces, and defining a raised frame around the raised image and a substantially flat rear perimeter;

front and rear panels covering the front and rear surfaces of said raised panel, wherein said rear panel is glued to the raised panel at said flat rear perimeter, and the front panel is hinged to the rest of the card; and an opening through said front panel making the raised panel visible from the front of the card when the front panel is covering the raised panel.

10. A card as recited in claim 9, and further defining a pocket on said front panel for receiving a compact disk or other flat object.

11. A card as recited in claim 3, wherein said raised image has a farthest-forward-projecting portion, and said raised frame projects forward at least as far as the farthest-forward-projecting portion of the raised image.

12. A card as recited in claim 1, wherein said raised image is at least 3/16-inch deep.

13. A card as recited in claim 11, wherein said raised image is at least 3/16-inch deep.

* * * * *